US012358686B2

(12) United States Patent
Delle Cese et al.

(10) Patent No.: US 12,358,686 B2
(45) Date of Patent: Jul. 15, 2025

(54) TAMPER-EVIDENT PEELABLE CLOSURE ATTACHMENT

(71) Applicant: Google LLC, Mountain View, CA (US)

(72) Inventors: Francesca Delle Cese, San Francisco, CA (US); Charles Hutchinson, Belmont, CA (US); Gabriel Sanchez, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 18/722,837

(22) PCT Filed: Nov. 9, 2023

(86) PCT No.: PCT/US2023/079202
§ 371 (c)(1),
(2) Date: Jun. 21, 2024

(87) PCT Pub. No.: WO2025/101190
PCT Pub. Date: May 15, 2025

(65) Prior Publication Data

US 2025/0153895 A1 May 15, 2025

(51) Int. Cl.
*B65D 17/50* (2006.01)

(52) U.S. Cl.
CPC ..... *B65D 17/502* (2013.01); *B65D 2401/05* (2020.05)

(58) Field of Classification Search
CPC ..... B65D 17/502; B65D 2401/05
See application file for complete search history.

(56) References Cited

U.S. PATENT DOCUMENTS 2,943,071 A * 6/1960 Laden ..... C09J 129/04 524/557
4,998,666 A * 3/1991 Ewan ..... B65D 55/026 229/162.1
5,148,970 A * 9/1992 Johnston ..... B65D 5/0227 229/102
2011/0232236 A1 9/2011 Chatelain et al.

FOREIGN PATENT DOCUMENTS

DE 19 18 167 U 6/1965
EP 0 388 061 A1 9/1990

OTHER PUBLICATIONS

International Search Report and Written Opinion for PCT/US2023/079202 dated May 27, 2024, all pages.

* cited by examiner

*Primary Examiner* — Christopher W Raimund
(74) *Attorney, Agent, or Firm* — Kilpatrick Townsend & Stockton LLP

(57) ABSTRACT

Various arrangements of a packaging lock system are presented. In some embodiments, the packaging lock system include a sleeve that defines a cutout region. The system can further include a packaging box sized to slide within the sleeve. The system further includes a peelable closure attachment that includes multiple layers. Such layers can include: a top layer in contact with an outside surface of the sleeve; a first adhesive layer that adheres to the top layer and a middle layer; and a second adhesive layer that adheres to the middle layer and to the packaging box.

18 Claims, 9 Drawing Sheets

TAMPER-EVIDENT PEELABLE CLOSURE ATTACHMENT

CROSS-REFERENCE TO RELATED APPLICATION

This application is a 371 National Stage filing of PCT Application No. PCT/US2023/079202, filed Nov. 9, 2023, and titled "TAMPER-EVIDENT PEELABLE CLOSURE ATTACHMENT." which is hereby incorporated by reference in its-entirety for all purposes.

BACKGROUND

For consumers and vendors alike, it is important to know that products have not been tampered with. A common way of making tampering evident is to shrink-wrap an entirety of a product's packaging. If the shrink-wrap is cut in any way, tampering may be assumed. Such an arrangement may not be preferable, however, because it creates a relatively difficult and annoying layer that needs to be removed by the consumer and can negatively affect the look and feel of the product when displayed. Alternative arrangements that prevent tampering are desirable.

SUMMARY

Various embodiments are described related to a tamper-evident peelable closure packaging system. In some embodiments, a tamper-evident peelable closure packaging system is described. The system may comprise a first packaging that defines an opening. The system may comprise a second packaging. The system may comprise a peelable closure attachment comprising a plurality of layers. The plurality of layers may comprise a top layer in contact with an outside surface of the first packaging. The plurality of layers may comprise a first adhesive layer that adheres to the top layer and a middle layer. The plurality of layers may comprise the middle layer. The middle layer may be located within the opening of the first packaging. The plurality of layers may comprise a second adhesive layer that adheres to the middle layer and to the second packaging.

Embodiments of such a system may include one or more of the following features: the first packaging may be a packaging sleeve and the second packaging may be a packaging box that is sized to slide within the packaging sleeve. When the packaging box is within the packaging sleeve, the packaging sleeve may prevent the packaging box from being opened. The top layer may overlap a region of the first packaging surrounding the opening. The first adhesive layer may be a differential adhesive such that a first bond with the top layer may be stronger than a second bond with the middle layer. The system may comprise, configured such that, when the top layer is peeled away from the first packaging, at least a portion of the middle layer may remain attached to the second packaging by the second adhesive layer. The system may comprise, configured such that, when the top layer is peeled away from the first packaging, a first sublayer of the middle layer may remain attached to the second packaging by the second adhesive layer and a second sublayer of the middle layer may remain attached to the top layer via the first adhesive layer. A combined thickness of the first adhesive layer, the middle layer, and the second adhesive layer may be within 10% of a material thickness of the first packaging. The first packaging may be configured to only be removable without damage after the top layer of the peelable closure attachment has been peeled. After peeling, the top layer cannot be readily reattached to a portion of the middle layer that may remain attached to the second packaging. No adhesive may adhere the top layer to the first packaging.

In some embodiments, a tamper-evident peelable closure packaging system is described. The system may comprise a packaging housing that defines an opening. The system may comprise a closable portion of the packaging housing that defines a packaging flap accessible through the opening of the packaging housing when the closable portion is closed. The system may comprise a peelable closure attachment comprising a plurality of layers. The plurality of layers may comprise a top layer in contact with an outside surface of the packaging housing. The plurality of layers may comprise a first adhesive layer that adheres to the top layer and a middle layer. The plurality of layers may comprise the middle layer. The middle layer may be located within the opening of the packaging housing. A second adhesive layer that may adhere to the middle layer and to the packaging flap.

Embodiments of such a system may include one or more of the following features: the first adhesive layer may be a differential adhesive such that a first bond with the top layer may be stronger than a second bond with the middle layer. The system may comprise, configured such that, when the top layer is peeled away from the packaging housing, at least a portion of the middle layer remains attached to the packaging flap by the second adhesive layer. The system may comprise, configured such that, when the top layer is peeled away from the packaging housing, a first sublayer of the middle layer remains attached to the packaging flap by the second adhesive layer and a second sublayer of the middle layer remains attached to the top layer via the first adhesive layer. A combined thickness of the first adhesive layer, the middle layer, and the second adhesive layer may be within 10% of a material thickness of the packaging housing. The packaging housing may be configured to only be removable without damage after the top layer of the peelable closure attachment has been peeled. After peeling, the top layer cannot be readily reattached to a portion of the middle layer that may remain attached to the packaging flap. No adhesive may adhere the top layer to the packaging housing.

In some embodiments, a method for using a tamper-evident peelable closure packaging system is described. The method may comprise providing packaging. The method may comprise a packaging housing that defines an opening. The method may comprise a closable portion of the packaging housing that defines a packaging flap accessible through the opening of the packaging housing when the closable portion is closed. The method may comprise a peelable closure attachment comprising a plurality of layers. The plurality of layers may comprise a top layer in contact with an outside surface of the packaging housing. The plurality of layers may comprise a first adhesive layer that adheres to the top layer and a middle layer. The plurality of layers may comprise the middle layer. The middle layer may be located within the opening of the packaging housing. The method may comprise providing packaging comprising a second adhesive layer that adheres to the middle layer and to the packaging flap. The method may comprise peeling the top layer away from the packaging housing, thereby causing permanent separation among the plurality of layers. The method may comprise removing a portion of the peelable closure attachment that comprises the top layer. The method may comprise, after removing the portion, opening the packaging.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Arrangements detailed herein are directed to peelable closure attachments and peelable closure attachment systems and methods. A peelable closure attachment can allow for a first packaging surface to be secured to a second packaging surface, such as to prevent tampering. The peelable closure attachment can be manually removed by a person, such as a consumer, but cannot be easily replaced. For example, once peeled, even partially, tampering may be evident by the peelable closure attachment being displaced, such as curled, from the first packaging surface.

A peelable closure attachment can include multiple layers of adhesive and a middle paper layer. When peeled from packaging, the peelable closure attachment separates by the middle paper layer either separating into two layers or the top layer separates from the middle layer. In both arrangements, once partially or fully peeled, the top layer cannot readily be reattached, thus making evident that the packaging has already been opened. When placed effectively, the peelable closure attachment needs to be fully peeled prior to a person opening the packaging.

Such arrangements of a peelable closure attachment can be relatively easy for a person to remove, thus improving the ability to open packaging, such as compared to shrink wrapping. The packaging, however, remains tamper evident, thus providing assurance to manufacturers, vendors, middlemen, and consumers that the product stored in the packaging has not been tampered with. Such peelable closure attachments can be used in combination with various forms of packaging, such as packaging boxes, packaging boxes with sleeves, and multi-flap packaging arrangements. While many various products can be packaged in such packaging protected using one or more peelable closure attachments, arrangements detailed herein are particularly useful for small consumer electronics, such as smartphones, smart home devices, smart thermostats, smart doorbells and other high-value electronics that can benefit from having tampering be evident, while allowing the packaging to be easy to access by the end consumer.

Figure 1:
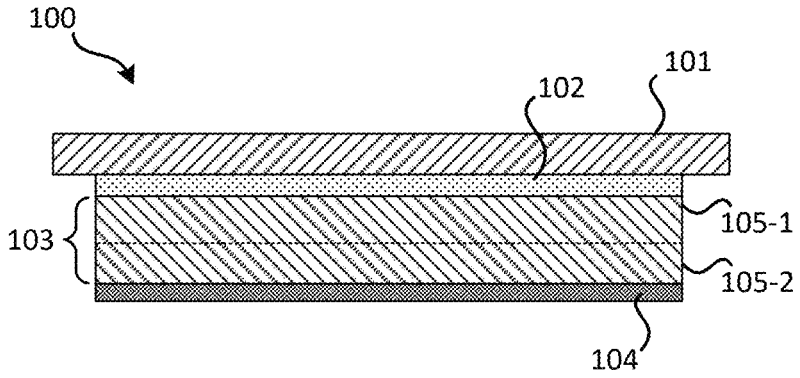
FIG. 1 illustrates an embodiment of a peelable closure attachment.

Further detail regarding such embodiments and additional embodiments are provided in relation to the figures. FIG. 1 illustrates a cross-section of an embodiment of a peelable closure attachment 100. Peelable closure attachment 100 can include: top layer 101; adhesive layer 102; middle layer 103; and adhesive layer 104. The layer sizes and thicknesses are not to scale and are exaggerated for ease of illustration.

Top layer 101 can be a paper layer. Top layer 101 can be larger than other layers, which can mechanically prevent a packaging from being opened without top layer 101 being fully removed. Top layer 101 may rest flush with a packaging layer, but may only be adhered to other layers of peelable closure attachment 100.

Adhesive layer 102 adheres top layer 101 to middle layer 103. Adhesive layer 102 can be a differential adhesive, such as a differential adhesive tape, that forms a permanent or strong bond on one side, but forms a removable or weak bond on the other side. For peelable closure attachment 100, adhesive layer 102 forms a strong or permanent bond with top layer 101 but forms a weak or removable bond with middle layer 103. An example of such a differential adhesive is Crown™ DT742YH. In other embodiments, adhesive layer 102 may not be a differential adhesive, such as a traditional adhesive that bonds equally to top layer 101 and middle layer 103. In some embodiments, a frangible seal is created at adhesive layer 102 that serves as an intended point of failure. For example, it may be possible to use starch to attach top layer 101 to middle layer 103. It may also be possible to create a direct bond between top layer 101 and middle layer 103 that services as the intended point of failure.

Middle layer 103 can be a paper layer. When top layer 101 is peeled, in a first set of embodiments, adhesive layer 102 detaches from middle layer 103. Alternatively, when top layer 101 is peeled, in a second set of embodiments, adhesive layer 102 (which may not be a differential adhesive) remains adhered to middle layer 103, and middle layer 103 separates into two sublayers, as indicated by sublayer 105-1 and sublayer 105-2.

Adhesive layer 104 permanently adheres middle layer 103 to a packaging surface. An example of such an adhesive is Crown™ DS10A1. Therefore, when top layer 101 is peeled, adhesive layer 104 and either sublayer 105-2 or middle layer 103 remains attached to the packaging. Further detail regarding the attachment to packaging is provided in relation to FIG. 2.

Figure 2:
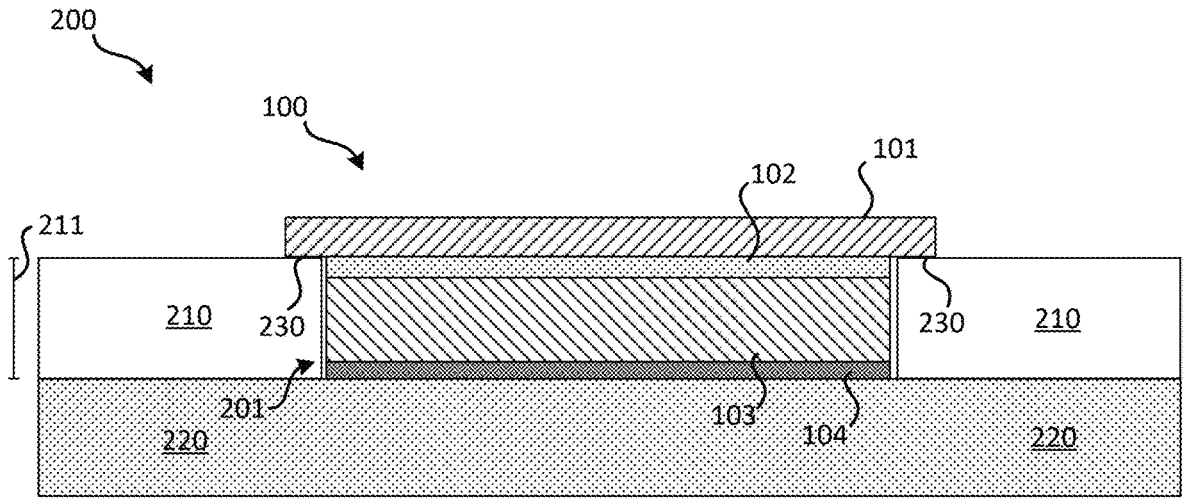
FIG. 2 illustrates an embodiment of a peelable closure attachment system.

FIG. 2 illustrates a cross-section of an embodiment of a peelable closure attachment system 200 ("system 200"). System 200 illustrates peelable closure attachment 100 being used to secure packaging 210 with packaging 220. Packaging 210 may be a packaging sleeve and packaging 220 may be a packaging box that can be slidably inserted into the sleeve. Alternatively, packaging 210 may be an outside of a packaging (e.g., a packaging box) and packaging 220 may be another portion of the same packaging, such as an inside flap.

System 200 includes peelable closure attachment 100, packaging 210, and packaging 220. In order to secure packaging, such as to make tampering evident, peelable closure attachment 100 must be peeled in order for packaging 210 to be moved in relation to packaging 220.

Generally, the interior of the packaging cannot be accessed unless peelable closure attachment 100 is peeled.

Opening 201 represents a hole that is defined by packaging 210. Top layer 101, by virtue of being physically larger (e.g., a greater surface area than an area of the hole) than an opening in packaging 210 through which other layer of peelable closure attachment 100 is installed, prevents packaging 210 from being slid relative to packaging 220 or pulled away from packaging 220. Adhesive layer 104 is adhered to packaging 220.

Top layer 101 can rest against packaging 210, such as at region 230, but no adhesive may be present. As such, a person, such as a consumer, can peel top layer 101 by working a fingernail or other firm object between packaging 210 and top layer 101 at region 230. Region 230 may entirely surround opening 201.

A combined thickness of adhesive layer 102, middle layer 103, and adhesive layer 104 may be the same as thickness 211 of packaging 210. While having the same thickness is idea, in other embodiments the combined thickness may be within +10%, 15%, or 20% (or within an inclusive range of between +1% and +25%) of thickness 211.

Once top layer 101 is peeled away, packaging 210 can be slid or moved away from packaging 220. Further, once top layer 101 is peeled away, it cannot be readily reattached by a person to middle layer 103 (or, if middle layer 103 is separated into two sublayers, the two-sublayers cannot be readily reattached together).

Figure 3:
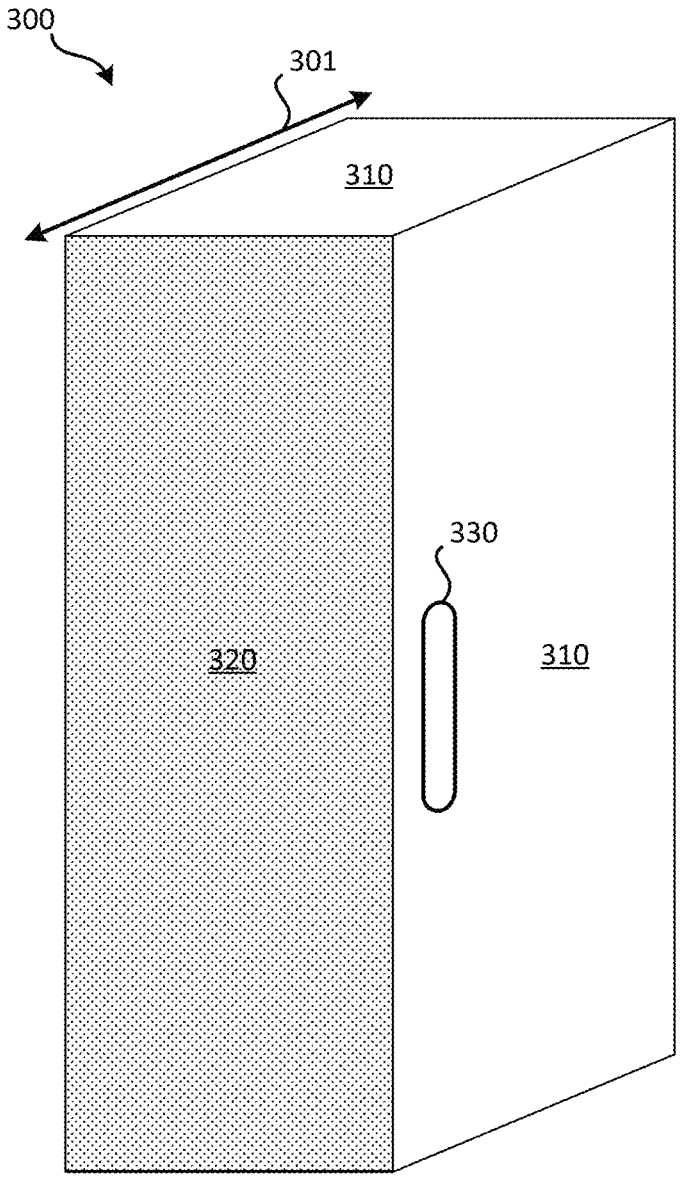
FIG. 3 illustrates an embodiment of a peelable closure attachment system that includes a packaging sleeve and a packaging box.

FIG. 3 illustrates an embodiment of a packaging system 300 ("system 300") that includes a packaging sleeve and a packaging box. In system 300, packaging sleeve 310 represents packaging 210 of FIG. 2 and packaging box 320 represents packaging 220 of FIG. 2. Packaging box 320 is sized to fit within packaging sleeve 310, thus allowing packaging box 320 to be slid into packaging sleeve 310 as represented by arrow 301. When packaging box 320 is inserted within packaging sleeve 310, the contents of packaging box 320 cannot be accessed (without damaging or destroying packaging box 320 and/or packaging sleeve 310).

Packaging sleeve 310 defines opening 330, which can also be called a hole or cutout region. Once packaging box 320 is installed in packaging sleeve 310, peelable closure attachment 100 can be attached to packaging box 320 through opening 330. By virtue of top layer 101 being larger than opening 330, top layer 101 cannot fit through opening 330 and thus prevents packaging sleeve 310 from being slid relative to packaging box 320 until top layer 101 is peeled away.

Notably, while system 300 shows a single opening through which peelable closure attachment 100 is affixed to packaging box 320, other embodiments can use multiple peelable closure attachments along with corresponding openings in packaging sleeve 310. For example, peelable closure attachments may be present on opposite sides of packaging sleeve 310 (e.g., as pictured and on the hidden side of packaging sleeve 310 to the left of packaging box 320).

Figure 4:
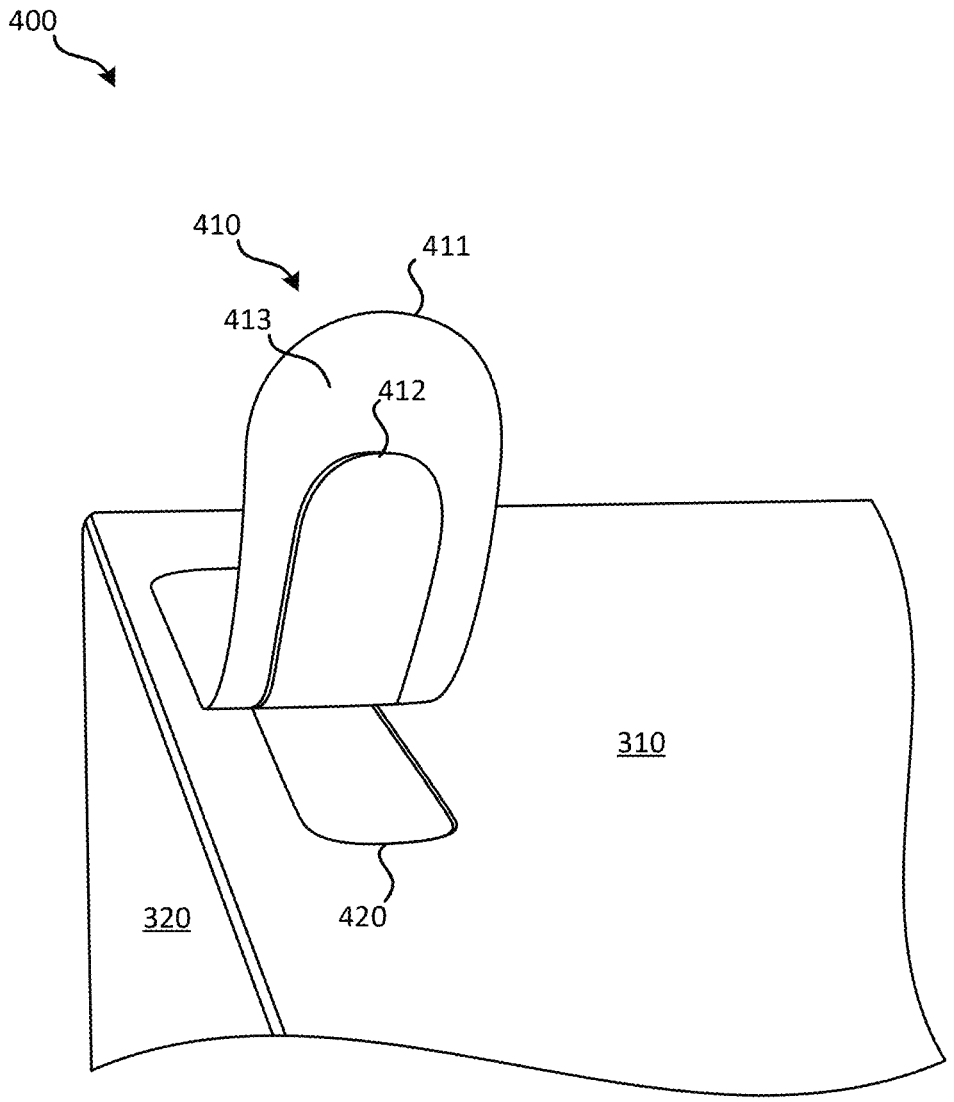
FIG. 4 illustrates an embodiment of a peelable closure attachment partially peeled from a packaging box.

FIG. 4 illustrates an embodiment of peelable closure attachment system 400 that includes top layer 411 partially peeled from packaging box 320. A person has peeled top layer 411 (which represents an embodiment of top layer 101) away from packaging sleeve 310. As can be seen, the area of top layer 411 is larger than opening 420 (which is an embodiment of opening 201). Top layer 411 is not adhered to packaging sleeve 310. For example, region 413, which can fully encircle adhesive 412 on a bottom side of top layer 411, does not include any adhesive. Adhesive 412 represents an embodiment of adhesive layer 102. Once top layer 411 is fully peeled, packaging sleeve 310 can be slid relative to packaging box 320, thus allowing packaging sleeve 310 to be removed, and then allowing packaging box 320 to be opened.

In some embodiments, top layer 411 may be shaped as a rectangle with rounded or semi-circular ends. This shape may make it relatively easy for a person to lift the unadhered end region 333 away from the outer surface of packaging sleeve 310 to begin peeling.

In embodiments where peeling results in middle layer 103 being separated into two sublayers, when top layer 411 is peeled away, sublayer 105-1 remains attached with adhesive 412, with sublayer 105-2 being left behind within opening 410.

Figure 5:
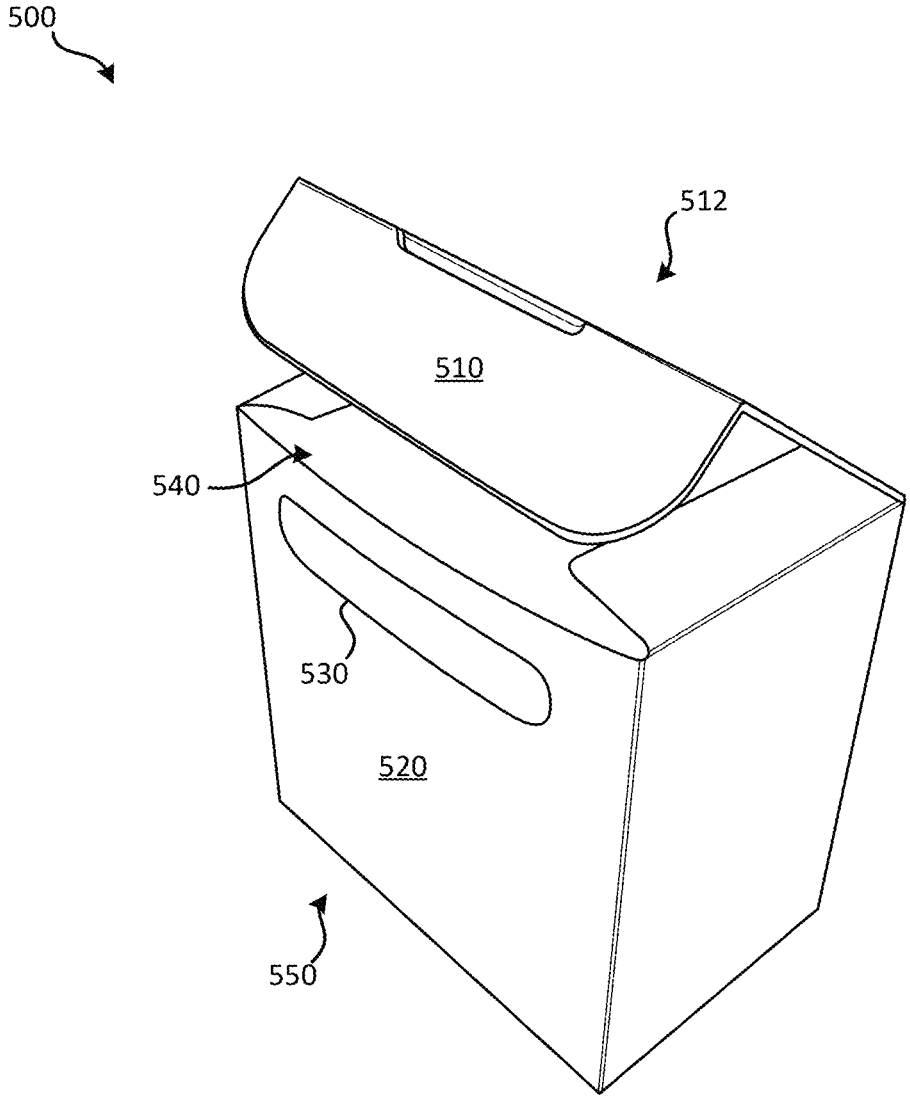
FIG. 5 illustrates another embodiment of packaging on which a peelable closure attachment can be used.

FIG. 5 illustrates an embodiment of packaging 500 on which a peelable closure attachment can be used. Packaging 500 can be in the form of a packaging box (as illustrated) or some other form, such as a pouch. Packaging 500 can include packaging surface 520 which defines opening 530. In this embodiment, packaging surface 520 represents packaging 210 of FIG. 2. Packaging 500 can further include flap 510, which is part of or attached with end 512 (not visible) of packaging 500. Flap 510 is inserted into opening 540 to close packaging 500. In this embodiment, flap 510 represents packaging 220 of FIG. 2. When flap 510 is inserted into opening 540, peelable closure attachment 100 can be used to secure flap 510 in place through opening 530, thus preventing packaging 500 from being opened without first peeling top layer 110 from peelable closure attachment 100.

The other end 550 of packaging 500 may be permanently sealed, such as by using a permanent adhesive. Alternatively, a second opening may be present to allow a second instance of peelable closure attachment 100 to be used to secure end 550.

Figure 6:
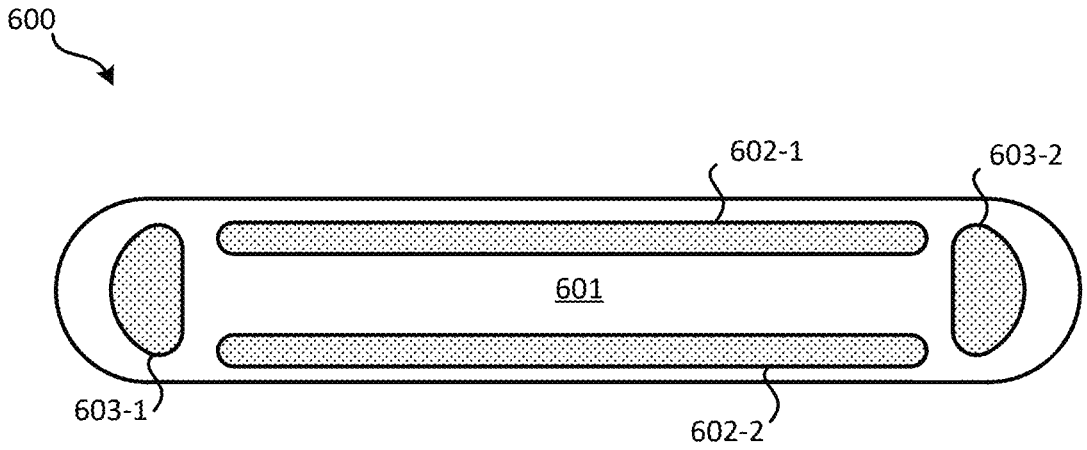
FIG. 6 illustrates another embodiment of a peelable closure attachment system.

FIG. 6 illustrates another embodiment of a peelable closure attachment 600. Multiple sections 602-1, 602-2, 603-1, and 603-2 can be attached with top layer 601, with each section including adhesive layer 102, middle layer 103, and adhesive layer 104. Peelable closure attachment 600 can be used to join two packaging surfaces, such as two flaps, thus preventing either flap from being opened without first peeling peelable closure attachment 600.

As illustrated, sections 602 may each be attached with different portions of a packaging, such as separate packaging flaps. Sections 603, which are optional, may be attached across packaging flaps to increase the ability of peelable closure attachment 600 to hold the flaps in the closed position.

Figure 7:
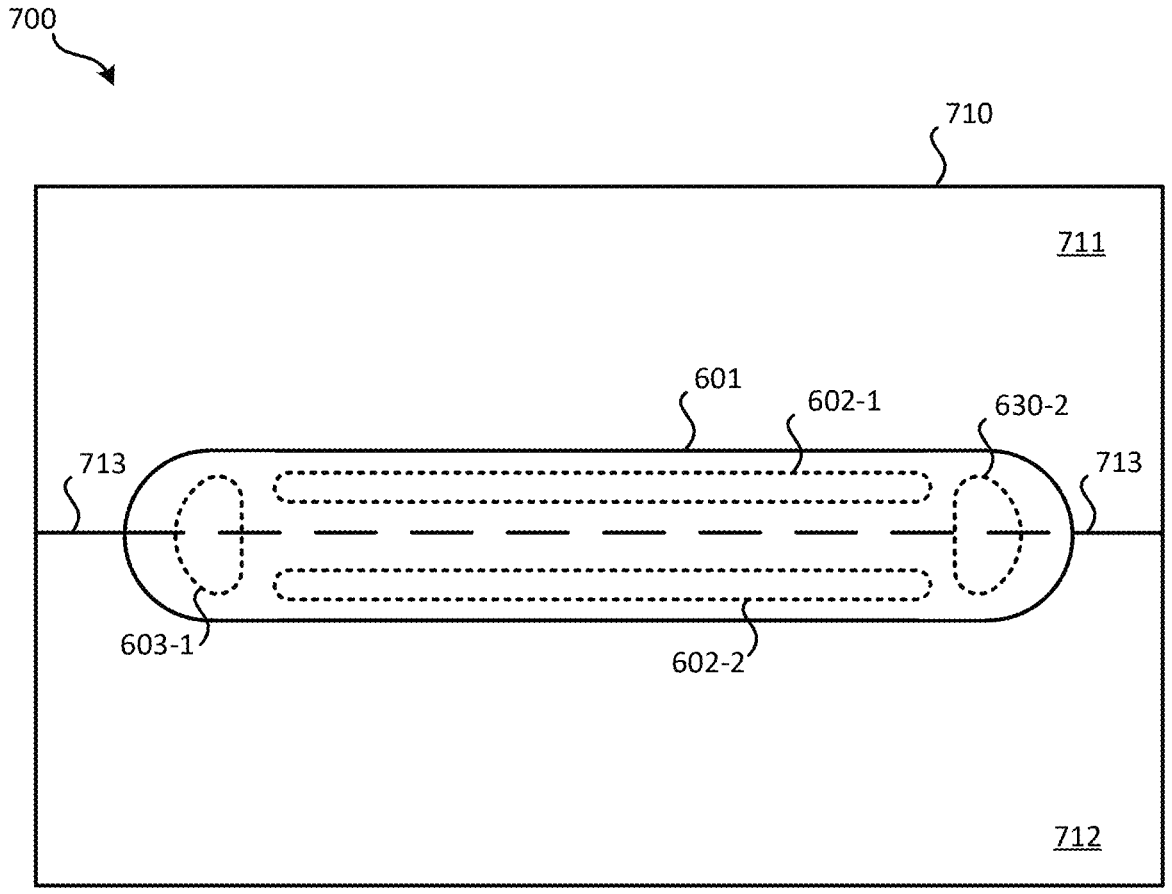
FIG. 7 illustrates use of a peelable closure attachment system on multi-flap packaging.

FIG. 7 illustrates a peelable closure attachment system 700 that includes the use of peelable closure attachment 600 on multi-face packaging 710. Multi-face packaging 710 includes face 711 and face 712. Faces 711 and 712 can be, for example, flap or faces of packaging. Face 711 and face 712 open in opposite directions and meet at seam 713. Peelable closure attachment 600 is placed over seam 713, such that section 602-1 is attached with face 711 and section 602-2 is attached with face 712. Sections 603 span both faces. In some embodiments, sections 603 are not present. The specific size and shape of sections 602 and 603 can vary by embodiment.

When peeled and top layer 601 is removed, all or a sublayer of middle layer 103 remaining attached with face 712 and face 711 can be broken and face 711 can be separate from face 712.

In other embodiments, only a single flap may be present. Replacing the other flap may be a fixed structure, such as a portion of a packaging box that does not open. Accordingly, the arrangements detailed in relation to FIGS. 6 and 7 can be used to seal and detect tampering with respect to two level, adjacent surfaces that are either touching or nearly touching (e.g., within 1-10 mm).

Figure 8:
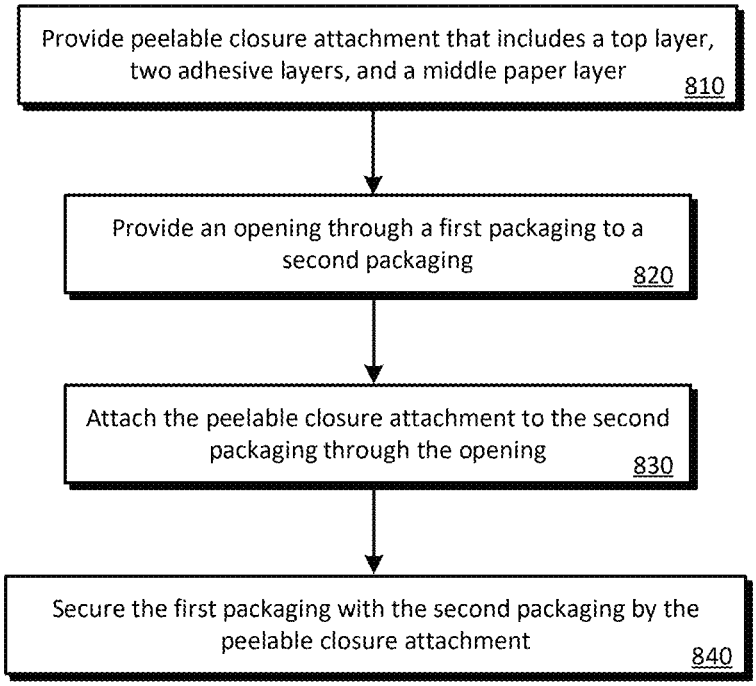
FIG. 8 illustrates an embodiment of a method for applying a peelable closure attachment.

Various methods may be performed using the arrangements of FIGS. 1-7. FIG. 8 illustrates an embodiment of a method 800 for applying a peelable closure attachment to seal and/or prevent tampering of packaging.

At block 810, a peelable closure attachment is provided. The peelable closure attachment comprises at least four layers as detailed in relation to FIGS. 1 and 2. In some embodiments, the peelable closure attachment is acquired fully labeled. In other embodiments, the peelable closure attachment is manufactured to have the layering as detailed in relation to FIG. 1.

At block 820, an opening through a first packaging to a surface of a second packaging is provided. In some embodiments, such as detailed in relation to FIG. 3, the first packaging is a packaging sleeve and the second packaging is a box, which cannot readily be opened unless the packaging sleeve is first removed. In other embodiments, such as in FIG. 5, the first packaging can be a box or pouch and the second packaging can be a flap of the packaging box or pouch. In some embodiments, block 820 includes punching or creating the opening in the first packaging. In other embodiments, the packaging is acquired with the opening already present.

At block 830, the peelable closure attachment is attached to the second packaging surface through the opening. The peelable closure attachment can be sized and shaped to fill the entirety of the opening, allowing for a small percentage gap for manufacturing tolerances between an edge of the peelable closure attachment and an edge of the opening. Block 830 can involve adhesive layer 104, which can be a pressure sensitive adhesive (PSA), being adhered to the second packaging surface by pressure being applied. When attached, a lower surface of the top layer of the peelable closure attachment should be approximately coplanar (e.g., within 10%, 15%, 20% of the overall thickness of the peelable closure attachment) with a top surface of the first packaging.

At block 840, the first packaging is secured with the second packaging by the peelable closure attachment. As detailed in relation to FIG. 1, an area of the top layer of the peelable closure attachment is larger than the area of the opening, thus preventing the top layer from being able to go through the opening. The top layer, in concert with the lower layers, mechanically prevents the first packaging from being moved or slid away from the second packaging without the top layer of the peelable closure attachment being first removed.

Figure 9:
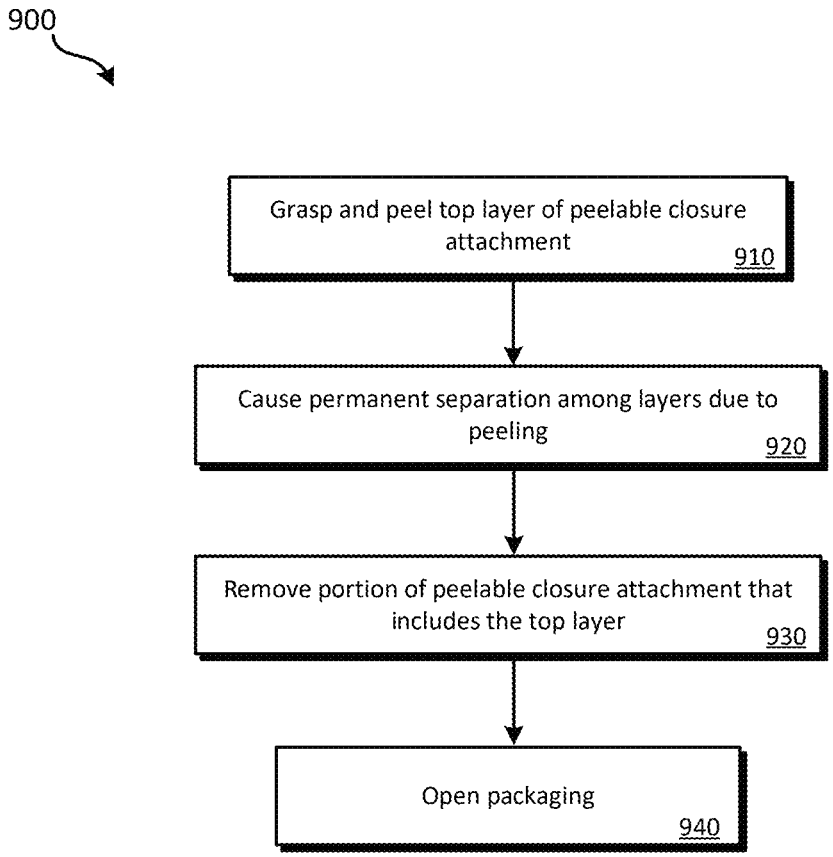
FIG. 9 illustrates an embodiment of a method for destructive removal of a peelable closure attachment.

FIG. 9 illustrates an embodiment of a method 900 for destructive removal of a peelable closure attachment, such as the arrangement of FIG. 1. The peelable closure attachment may first have been adhered to packaging as detailed in relation to FIG. 8. Additionally, method 900 can be used in conjunction with peelable closure attachment 600 of FIG. 6.

At block 910, the top layer of the peelable closure attachment may be grasped and peeled. The top layer of the peelable closure attachment is not adhered to the first packaging, thus a person, such as an end consumer, can mechanically pull the top layer of the peelable closure attachment away from the first packaging. The end consumer may continue pulling such that the top layer is peeled (with one or more layers remaining attached) away from the portion of the peelable closure attachment that remains attached to the second packaging.

At block 920, the peeling of block 910 causes permanent separation among layers of the peelable closure attachment. In some embodiments, the peeling of the top layer results in only top layer 101 and adhesive layer 102 being peeled away from the second packaging and the remainder of the peelable closure attachment. In other embodiments, the peeling of the top layer results in the top layer 101, adhesive layer 102, and a sublayer of middle layer 103 being peeled away from the second packaging and the remainder of the peelable closure attachment. The portion peeled cannot be re-adhered (e.g., without the addition of a new adhesive).

At block 930, a portion of the peelable closure attachment that includes the top layer is fully removed. This portion can then be discarded or recycled. At block 940, the packaging can be opened due to the top layer no longer preventing the first packaging from being moved away from the second packaging. Block 930 can include sliding a packaging sleeve off of a packaging box. Block 930 can alternatively involve removing a flap from being tucked into a packaging box. Block 930 can alternatively involve hinging the first or second packaging away from the other packaging.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known, processes, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A tamper-evident peelable closure packaging system, comprising:

a first packaging that defines an opening;

a second packaging; and a peelable closure attachment comprising a plurality of layers, the plurality of layers comprising:

a top layer in contact with an outside surface of the first packaging, wherein no adhesive is present in a region between the top layer and the first packaging;

a first adhesive layer that adheres to the top layer and a middle layer;

the middle layer, wherein the middle layer is located within the opening of the first packaging; and a second adhesive layer that adheres to the middle layer and to the second packaging.

2. The tamper-evident peelable closure packaging system of claim 1, wherein the first packaging is a packaging sleeve and the second packaging is a packaging box that is sized to slide within the packaging sleeve.

3. The tamper-evident peelable closure packaging system of claim 2, wherein, when the packaging box is within the packaging sleeve, the packaging sleeve prevents the packaging box from being opened.

4. The tamper-evident peelable closure packaging system of claim 1, wherein the top layer overlaps a region of the first packaging surrounding the opening.

5. The tamper-evident peelable closure packaging system of claim 1, wherein the first adhesive layer is a differential adhesive such that a first bond with the top layer is stronger than a second bond with the middle layer.

6. The tamper-evident peelable closure packaging system of claim 1, configured such that, when the top layer is peeled away from the first packaging, at least a portion of the middle layer remains attached to the second packaging by the second adhesive layer.

7. The tamper-evident peelable closure packaging system of claim 1, configured such that, when the top layer is peeled away from the first packaging, a first sublayer of the middle layer remains attached to the second packaging by the second adhesive layer and a second sublayer of the middle layer remains attached to the top layer via the first adhesive layer.

8. The tamper-evident peelable closure packaging system of claim 1, wherein a combined thickness of the first adhesive layer, the middle layer, and the second adhesive layer is within 10% of a material thickness of the first packaging.

9. The tamper-evident peelable closure packaging system of claim 1, wherein the first packaging is configured to only be removable without damage after the top layer of the peelable closure attachment has been peeled.

10. The tamper-evident peelable closure packaging system of claim 9, wherein after peeling, the top layer cannot be readily reattached to a portion of the middle layer that remains attached to the second packaging.

11. A tamper-evident peelable closure packaging system, comprising:

a packaging housing that defines an opening;

a closable portion of the packaging housing that defines a packaging flap accessible through the opening of the packaging housing when the closable portion is closed;

a peelable closure attachment comprising a plurality of layers, the plurality of layers comprising:

a top layer in contact with an outside surface of the packaging housing, wherein no adhesive is present in a region between the top layer and the packaging housing;

a first adhesive layer that adheres to the top layer and a middle layer;

the middle layer, wherein the middle layer is located within the opening of the packaging housing; and a second adhesive layer that adheres to the middle layer and to the packaging flap.

12. The tamper-evident peelable closure packaging system of claim 11, wherein the first adhesive layer is a differential adhesive such that a first bond with the top layer is stronger than a second bond with the middle layer.

13. The tamper-evident peelable closure packaging system of claim 11, configured such that, when the top layer is peeled away from the packaging housing, at least a portion of the middle layer remains attached to the packaging flap by the second adhesive layer.

14. The tamper-evident peelable closure packaging system of claim 11, configured such that, when the top layer is peeled away from the packaging housing, a first sublayer of the middle layer remains attached to the packaging flap by the second adhesive layer and a second sublayer of the middle layer remains attached to the top layer via the first adhesive layer.

15. The tamper-evident peelable closure packaging system of claim 11, wherein a combined thickness of the first adhesive layer, the middle layer, and the second adhesive layer is within 10% of a material thickness of the packaging housing.

16. The tamper-evident peelable closure packaging system of claim 11, wherein the packaging housing is configured to only be removable without damage after the top layer of the peelable closure attachment has been peeled.

17. The tamper-evident peelable closure packaging system of claim 16, wherein after peeling, the top layer cannot be readily reattached to a portion of the middle layer that remains attached to the packaging flap.

18. A method for using a tamper-evident peelable closure packaging system, the method comprising:

providing packaging, comprising:

a packaging housing that defines an opening;

a closable portion of the packaging housing that defines a packaging flap accessible through the opening of the packaging housing when the closable portion is closed;

a peelable closure attachment comprising a plurality of layers, the plurality of layers comprising:

a top layer in contact with an outside surface of the packaging housing, wherein no adhesive is present in a region between the top layer and the packaging housing;

a first adhesive layer that adheres to the top layer and a middle layer;

the middle layer, wherein the middle layer is located within the opening of the packaging housing; and a second adhesive layer that adheres to the middle layer and to the packaging flap;

peeling the top layer away from the packaging housing, thereby causing permanent separation among the plurality of layers;

removing a portion of the peelable closure attachment that comprises the top layer; and after removing the portion, opening the packaging.

* * * * *